United States Patent [19]

Larsson et al.

[11] Patent Number: 5,038,874

[45] Date of Patent: Aug. 13, 1991

[54] DRILL BIT HAVING A FLUSHING MEDIUM CHANNEL

[75] Inventors: Lars K. Larsson; Sven P. Liljebrand, both of Sandviken, Sweden

[73] Assignee: Sandvik AB, Sandviken, Sweden

[21] Appl. No.: 475,258

[22] Filed: Feb. 5, 1990

[30] Foreign Application Priority Data

Mar. 13, 1989 [SE] Sweden ..... 8900473-3

[51] Int. Cl.[5] ..... E21B 17/07

[52] U.S. Cl. ..... 175/322; 175/418; 175/415; 175/393; 173/78; 173/80; 173/126

[58] Field of Search ..... 175/320, 321, 393, 414, 175/415, 418; 173/57, 73, 78, 80, 126, DIG. 3

[56] References Cited

U.S. PATENT DOCUMENTS

| | | | |
|---|---|---|---|
| 791,264 | 5/1905 | Hardsocg | 175/417 X |
| 3,101,796 | 8/1963 | Stall et al. | 173/80 X |
| 3,595,323 | 7/1971 | Schindler et al. | 173/80 X |
| 3,712,388 | 1/1973 | Curington | 173/78 |
| 3,804,181 | 4/1974 | Curington et al. | 173/80 X |
| 3,866,746 | 2/1975 | Curington | 173/80 X |
| 4,043,409 | 8/1977 | Walter | 175/321 |
| 4,770,259 | 9/1988 | Jansson | 175/292 |
| 4,805,705 | 2/1989 | Liljebrand et al. | 173/80 |
| 4,961,469 | 10/1990 | Larsson et al. | 175/293 |

*Primary Examiner*—Ramon S. Britts
*Assistant Examiner*—Roger J. Schoeppel
*Attorney, Agent, or Firm*—Burns, Doane, Swecker & Mathis

[57] ABSTRACT

A drill string for top hammer drilling includes a drill bit, a set of central rod members for transferring impact energy to the drill bit, and a set of tubular members surrounding the rod members for transferring rotation to the drill bit. The rod members define a first internal channel for conducting flushing medium. The drill bit defines a second internal channel which extends rearwardly and penetrates a rear end of the drill bit to communicate with the first channel. The drill bit further includes a transverse channel disposed in an intermediate section of the drill bit and which is connected to the second channel. The transverse channel penetrates an envelope surface of the drill bit for conducting flushing medium out of the drill bit and into an enlarged space defined between the drill bit and the tubular member. Flushing medium discharged through the transverse channel supplies lubricant to a splined connection between the drill bit and the tubular member, and equalizes pressure between the second internal channel and the space between the drill bit and the tubular member.

9 Claims, 2 Drawing Sheets

DRILL BIT HAVING A FLUSHING MEDIUM CHANNEL

BACKGROUND AND OBJECTS OF THE INVENTION

The present invention relates to a drill bit that is intended to be included in a drill string for top hammer drilling. The drill string includes a set of central rod members for transferring impact energy to the drill bit from a top hammer, and a set of tubular members surrounding the set of rod members for transferring rotation to the drill bit. The invention also relates to a tubular member and a drill string.

From Lundstrom et al U.S. Pat. No. 4,094,364, a device of the above-mentioned kind is previously known. The set of central rod members comprises relatively massive rods, and flushing medium is fed to the drill bit via an annular space formed between the set of rod members and the set of tubular members. The drill bit is closed at its rear or upper impact-receiving end. A central channel for flushing fluid begins forwardly of the closed rear end of the drill bit and communicates with the annular channel by means of a transverse passage to receive flushing medium and discharge that medium at the front of the drill bit.

The reason for closing the rear end of the drill bit is that the energy transferring surface of the rods and drill bit must be sufficiently large in order to make possible the use of top hammer equipment that generates enough energy to achieve a satisfying drill penetration rate. For drills which make larger drill hole diameters, especially exceeding 125 mm, the rod members have a sufficiently large diameter to accommodate an internal flushing channel. Such a channel extends longitudinally completely through each rod and communicates with a channel which extends longitudinally completely through the drill bit. However, such an internal flushing channel provides insufficient lubrication for the splined coupling between the drill bit and the tubular member. Furthermore, in the case where the drill bit comprises loosely abutting pieces, the flushing medium traveling through the flushing channel may, as it jets past the loose parting line between the drill bit pieces, create a suction in the space disposed outside of the drill bit. Consequently, cuttings (crushed rock) at the front of the drill bit can be sucked into the splined coupling and damage same.

An object of the present invention is to provide a drill bit and a tubular member included in a drill string as described above, cooperating to eliminate the problems discussed above.

SUMMARY OF THE INVENTION

The present invention involves a drill string for top hammer drilling which includes a drill bit, a set of central rod members for transferring impact energy to the drill bit, and a set of tubular members surrounding the set of rod members for transferring rotation to the drill bit. The set of central rod members has an axially extending, longitudinally continuous first channel for flushing medium. The drill bit has an axially extending second channel for flushing medium communicating with to the first channel, and a transverse channel disposed in an intermediate section of the drill bit. The transverse channel is connected to the second channel and penetrates an envelope surface of the drill bit for conducting flushing medium out of the drill bit at a location rearwardly of a forward end of the drill bit. One of the tubular members is provided with an internal enlargement defining a recess surrounding the outlet of the transverse channel.

The invention also relates to the drill bit per se, and to a tubular member per se.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
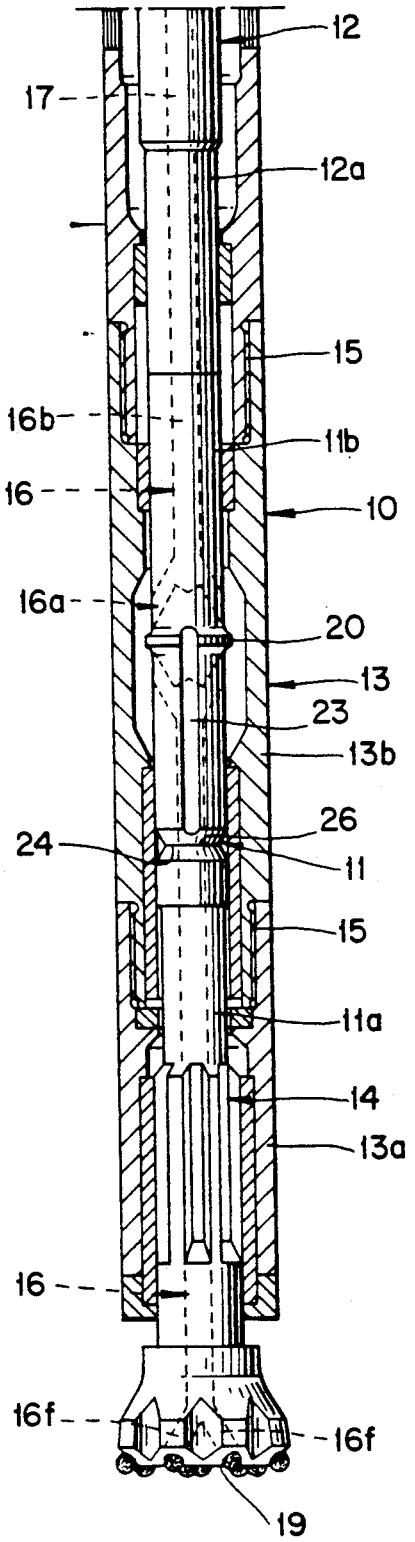
FIG. 1 shows a longitudinal sectional view through the tubular members of a drill string according to the invention, with the percussion-transmitting members disposed centrally within the tubular members being shown in side elevation.

FIG. 1 shows the lower or front portion of a drill string 10 including a drill bit 11 according to the present invention. The drill bit 11 comprises separate pieces 11*a* and 11*b* resting loosely against each other. That is, a forward face 24 of the rear piece 11*b* loosely engages a rear face 26 of the front piece 11*a*. However, within the scope of the invention it is also possible to employ a one-piece drill bit.

The rear or upper portion 11*b* of the drill bit 11 contacts with the forwardmost rod 12*a* of the central set of rod members 12 that transfers impact energy from the top hammer to the drill bit 11. The front end of that rod 12*a* rests loosely against the rear end of the rear piece 11*b*.

The set of tubular members 13 surrounding the set of rod members 12 and the drill bit 11 transfers rotation from the top hammer equipment to the drill bit 11. This is effected by a splined coupling 14 between the forwardmost tubular member 13*a* and the drill bit 11. The tubular members 13 are connected together by thread couplings 15.

As is apparent from FIG. 1, the drill bit 11 is provided with an axially extending flushing medium channel 16. The set of central rods 12 also has an axially extending flushing medium channel 17.

Figure 2:
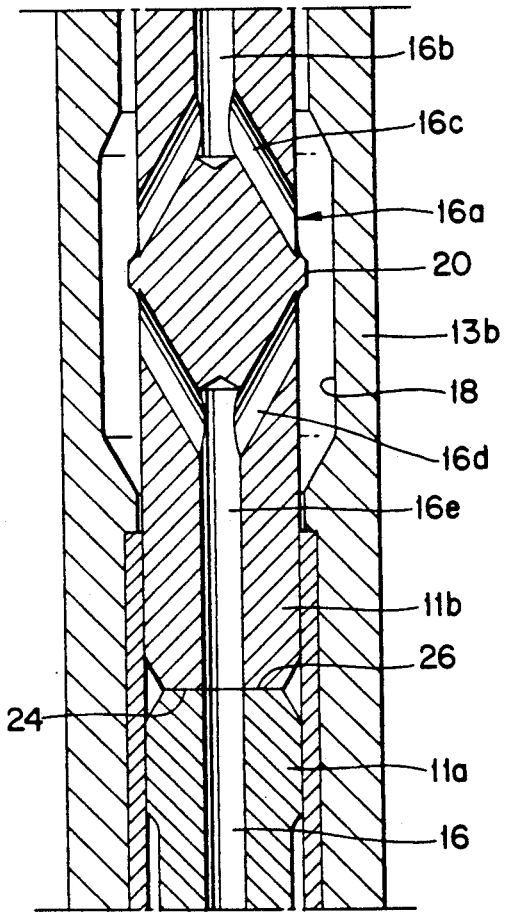
FIG. 2 is a fragmentary longitudinal sectional view of the drill string according to FIG. 1.

In the rear piece 11*b* of the drill bit 11 the channel 16 has an intermediate section 16*a* that is located rearwardly of the splined coupling as shown in detail in FIG. 2. As is apparent from FIG. 2, a longitudinally extending portion 16*b* of the channel 16 communicates with two branch channels 16*c* that are inclined relative to the longitudinal axis of the channel 16. The branch channels 16*c* penetrate the peripheral or envelope surface of the upper piece 11*b* and communicate with an enlarged internal recess 18 formed in a surrounding tubular member 13*b* of the set of tubular members 13.

From the recess 18 two further branch channels 16*d* slope forwardly and inwardly relative to the center axis and connect with a forwardly directed portion 16*e* of the channel 16.

The channel 16 extends through the front piece 11*a* of the drill bit 11 and emerges via discharge channels 16*f* in the front face 19 of the drill bit 11.

The above-described drill bit 11 functions in the following way. The flushing medium normally comprises air mixed with a lubricant, e.g., oil. When the flushing medium flowing towards the drill bit 11 reaches the section 16*a* of the channel 16, the flushing medium will, via the branch channels 16*c*, emanate into the recess 18 and from there, via the branch channels 16*d*, will travel to the forwardly directed portion 16*e* of the channel 16 and then continue flowing towards the front face 19 of the drill bit 11. When the flushing medium enters the recess 18, lubricant oil will impinge upon the surface of the recess 18, and then trickle downwardly within the space formed between the drill bit 11 and the set of tubular members 13. As a result, the splined coupling 14 between the front piece 11*a* of the drill bit 11 and the forwardmost tubular member 13*a* of the set of tubular members 13 automatically receives a proper amount of lubrication.

A further advantage of the section 16*a* according to the present invention is that it enables a pressure equalization to take place between the channel 16 on the one hand and the space defined between the front piece 11*a* of the drill bit 11 and the forwardmost tubular member 13*a* of the set of tubular members 13 on the other hand. That pressure equalization eliminates a problem which could result from the two-piece construction 11*a*, 11*b* of the drill bit. That is, since the pieces 11*a* and 11*b* of the drill bit 11 loosely rest against each other at their parting plane with an accompanying play, a jet action resulting from the flow of flushing medium past the parting plane may create a vacuum within the space defined between the drill bit 11 and the set of tubular members 13. Such a vacuum could suck cuttings rearwardly through a gap defined between the front piece 11*a* of the drill bit 11 and the forwardmost member 13*a* of the set of tubular members 13. Those cuttings would damage the splined coupling 14. The arrangement of the section 16*a* eliminates the risk for the creation of a vacuum of the type described, because of the pressure equalization which is achieved between the channel 16 and the space surrounding the drill bit.

In the area of the section 16*a*, the rear piece 11*b* of the drill bit 11 is provided with an annular ring 20 which serves as a travel limiter preventing the piece 11*b* from sliding out of the tubular member 13*b* when the front piece 11*a* of the drill bit 11 is removed for exchange or service. A fluid channel 23 extends vertically along the outer periphery of the rear piece 11*b* and through the ring 20.

Figure 3:
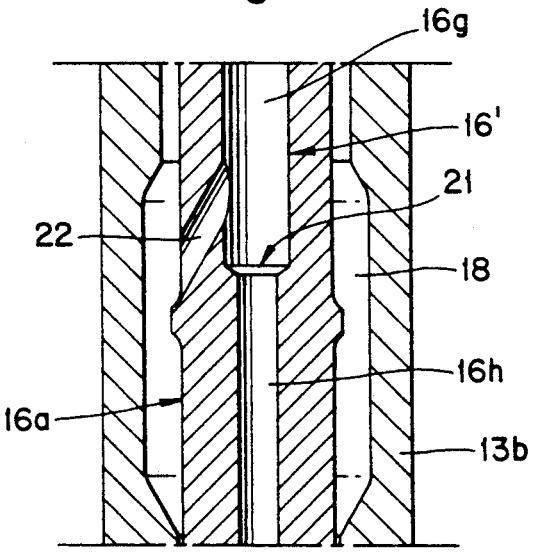
FIG. 3 shows a detail of an alternative embodiment of the invention.

An alternative embodiment of the invention is depicted in FIG. 3 and includes a drill bit having a longitudinally continuous flushing medium channel 16', the channel 16' being provided with a throttle 21. A portion 16*g* of the channel 16' located upstream of the throttle 21 has a bigger diameter than the portion 16*h* of the channel 16' located downstream of the throttle 21.

Upstream of the throttle 21, a transverse channel 22 is provided. Channel 22 extends from the portion 16*g* of the channel 16' and penetrates the envelope surface of the drill bit 11. The transverse channel 22 communicates with an internal recess 18 in a surrounding tubular member 13*b*.

The apparatus disclosed in connection with FIG. 3 functions under the same principles as the embodiment described in connection with FIGS. 1 and 2. That is, lubricating oil reaches the recess 18 through the transverse channel 22 and trickles downwardly to lubricate the splined coupling. Also, the transverse channel 22 produces a pressure equalization between the channel 16 and the space defined between the set of tubular members 13 and the drill bit piece 11*a*.

Figure 4:
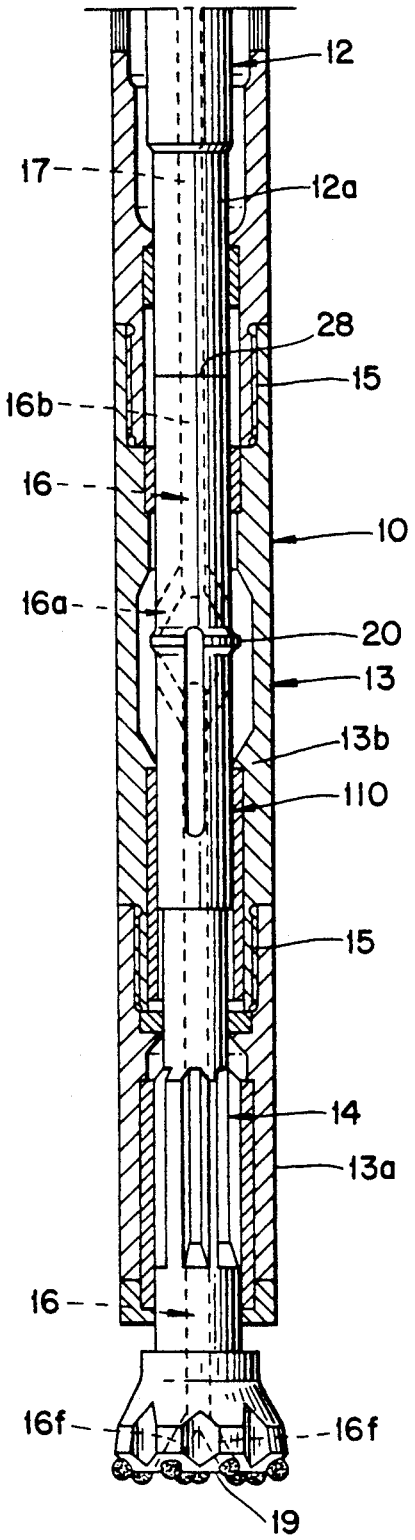
FIG. 4 is a view similar to FIG. 1 of an alternative embodiment wherein the drill bit is formed of one piece.

As noted earlier herein, the drill bit can be of one-piece construction. Such an arrangement is depicted in FIG. 4 wherein the front cutting face 19 and the transverse channels are rigidly coupled together by being formed in a common body 110.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A drill bit adapted to be disposed within a drill string for top hammer drilling wherein impact energy is transmitted to the drill bit through a plurality of central rod members, said drill bit including separate front and rear pieces, said front piece including a front cutting face and a first rear face, said rear piece including a forward face resting loosely against said first rear face, said forward face and first rear face defining a parting plane between said front and rear pieces, said drill bit including an axially extending channel passing across said parting plane for conducting a flushing fluid to said front cutting face, said axially extending channel being axially interrupted to an intermediate section of said rear piece to define front and rear channel portions in said rear piece, said rear channel portion penetrating a second rear face of said rear piece and terminating at said intermediate section, said front channel portion extending from said intermediate section and penetrating said forward face, said rear piece including first and second transverse channels, said first transverse channel being conducted to said rear channel portion and penetrating an envelope surface of said rear piece to form an outlet, said second transverse channel being connected to said front channel portion and penetrating said envelope surface to form an inlet, whereby flushing fluid exiting said outlet of said first transverse channel may enter said inlet of said second transverse channel, said front channel portion constituting the sole fluid-conducting channel penetrating said forward face.

2. A drill bit according to claim 1 wherein there are a plurality of said first transverse channels and a plurality of said second transverse channels formed in said rear piece.

3. A drill bit adapted to be disposed within a drill string for top hammer drilling wherein impact energy is transmitted to the drill bit through a plurality of central rod members, said drill bit having a front cutting face and an axially extending channel for conducting a flushing fluid to said front cutting face, said axially extending channel being axially interrupted at a location rearwardly of said front cutting face to define axially spaced front and rear channel portions, said rear channel portion terminating behind said front channel portion, said front channel portion penetrating said front cutting face, said drill bit including first and second transverse channels, said first transverse channel being connected to said rear channel portion and penetrating an envelope surface of said drill bit to form an outlet, said second transverse channel being connected to said front channel portion and penetrating said envelope surface to form an inlet, whereby flushing fluid exiting said outlet of said first transverse channel may enter said inlet of said second transverse channel, said first and second transverse channels being formed in a common body with said front cutting face so as to be rigidly coupled to said front cutting face.

4. A drill bit according to claim 3 wherein there are a plurality of said first transverse channels and a plurality of said second transverse channels formed in said drill bit.

5. A drill string for top hammer drilling including a drill bit having a front cutting face, a plurality of central rod members disposed above said drill bit for transferring impact energy to said drill bit, and a plurality of tubular members surrounding said plurality of rod members for transferring rotation to said drill bit, said tubular members forming an inner surface facing an envelope surface of said drill bit, said central rod members forming an axially extending first channel for flushing fluid extending completely through said plurality of rod members, said drill bit having an axially extending second channel communicating with said fist axially extending channel for conducting the flushing fluid to said front cutting face, said second axially extending channel being axially interrupted at an intermediate section of said drill bit to define axially spaced front and rear channel portions in said drill bit, said drill bit including first and second transverse channels, said first transverse channel being connected to said rear channel portion and penetrating said envelope surface of said drill bit, said second transverse channel penetrating said envelope surface and connected to said front channel portion, said first and second transverse channels communicating with one another by a space formed between said envelope surface and said inner surface, said space being configured to continuously communicate said first and second transverse channels with one another during a drilling operation when said front cutting face contacts the bottom of a hole being drilled.

6. A drill string according to claim 5 wherein said drill bit comprises separate front and rear pieces, said rear piece including a forward face resting loosely against a rear face of said front piece, said forward and rear faces defining a parting plane between said front and rear pieces, said axially extending channel passing across said parting plane, said front channel portion being situated in said rear piece and penetrating said forward face.

7. A drill string according to claim 6 wherein said front channel portion constitutes the sole fluid-conducting channel penetrating said forward face.

8. A drill string according to claim 5 wherein said drill bit includes a one-piece body, said body having said front cutting face and said intermediate section.

9. A drill string according to claim 5 wherein there are a plurality of said first transverse channels and a plurality of said second transverse channels formed in said drill bit.

* * * * *